US009242136B1

(12) United States Patent
Perez

(10) Patent No.: US 9,242,136 B1
(45) Date of Patent: Jan. 26, 2016

(54) EXERCISE ASSEMBLY

(71) Applicant: Ivan Perez, Hialeah, FL (US)

(72) Inventor: Ivan Perez, Hialeah, FL (US)

( * ) Notice: Subject to any disclaimer, the term of this patent is extended or adjusted under 35 U.S.C. 154(b) by 146 days.

(21) Appl. No.: 14/048,193

(22) Filed: Oct. 8, 2013

(51) Int. Cl.
*A63B 21/00* (2006.01)

(52) U.S. Cl.
CPC ..... *A63B 21/1449* (2013.01)

(58) Field of Classification Search
CPC ..... A63B 21/00
USPC ..... 482/44, 49
See application file for complete search history.

(56) References Cited

U.S. PATENT DOCUMENTS

| | | | | |
|---|---|---|---|---|
| 3,347,547 | A | 10/1967 | Hynes | |
| 3,944,220 | A | 3/1976 | Fasano | |
| 4,830,360 | A | 5/1989 | Carr, Jr. | |
| 5,113,849 | A | 5/1992 | Kuiken | |
| 5,135,217 | A | 8/1992 | Swain | |
| 5,453,064 | A | 9/1995 | Williams, Jr. | |
| D436,148 | S | 1/2001 | Villepigue | |
| 2010/0222189 | A1 * | 9/2010 | Washington | 482/124 |
| 2013/0041302 | A1 | 2/2013 | Williams | |

* cited by examiner

*Primary Examiner* — Jerome W Donnelly

(57) ABSTRACT

An exercise assembly for selectively providing resistance to a user's hand includes an article of apparel that may be worn on a user's hand. A resistance band is operationally coupled to the article of apparel. A handle is operationally coupled to the article of apparel. The handle is coupled to the resistance band. The handle selectively places the resistance band in a resisting position. The resistance band provides resistance to the user's hand.

15 Claims, 5 Drawing Sheets

EXERCISE ASSEMBLY

BACKGROUND OF THE DISCLOSURE

Field of the Disclosure

The disclosure relates to exercise devices and more particularly pertains to a new exercise device for selectively providing resistance to a user's hand.

SUMMARY OF THE DISCLOSURE

An embodiment of the disclosure meets the needs presented above by generally comprising an article of apparel that may be worn on a user's hand. A resistance band is operationally coupled to the article of apparel. A handle is operationally coupled to the article of apparel. The handle is coupled to the resistance band. The handle selectively places the resistance band in a resisting position. The resistance band provides resistance to the user's hand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
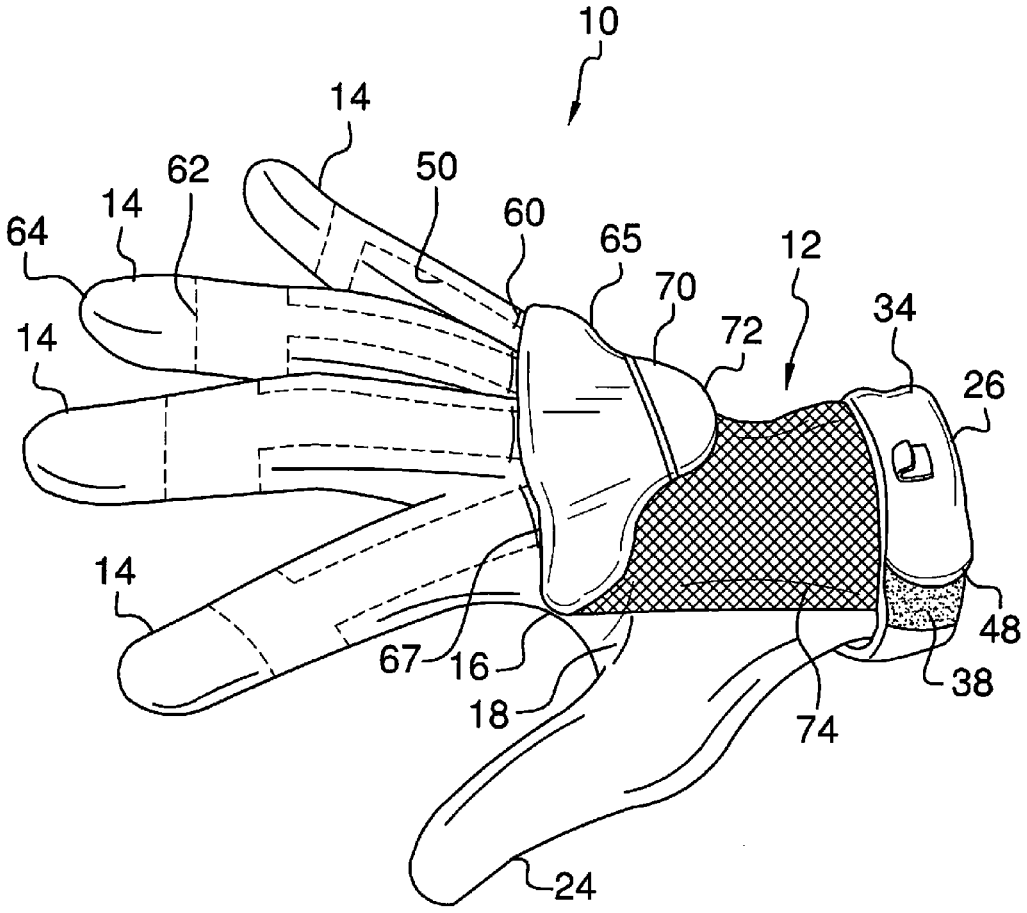
FIG. 1 is a perspective view of a exercise assembly according to an embodiment of the disclosure.
Figure 2:
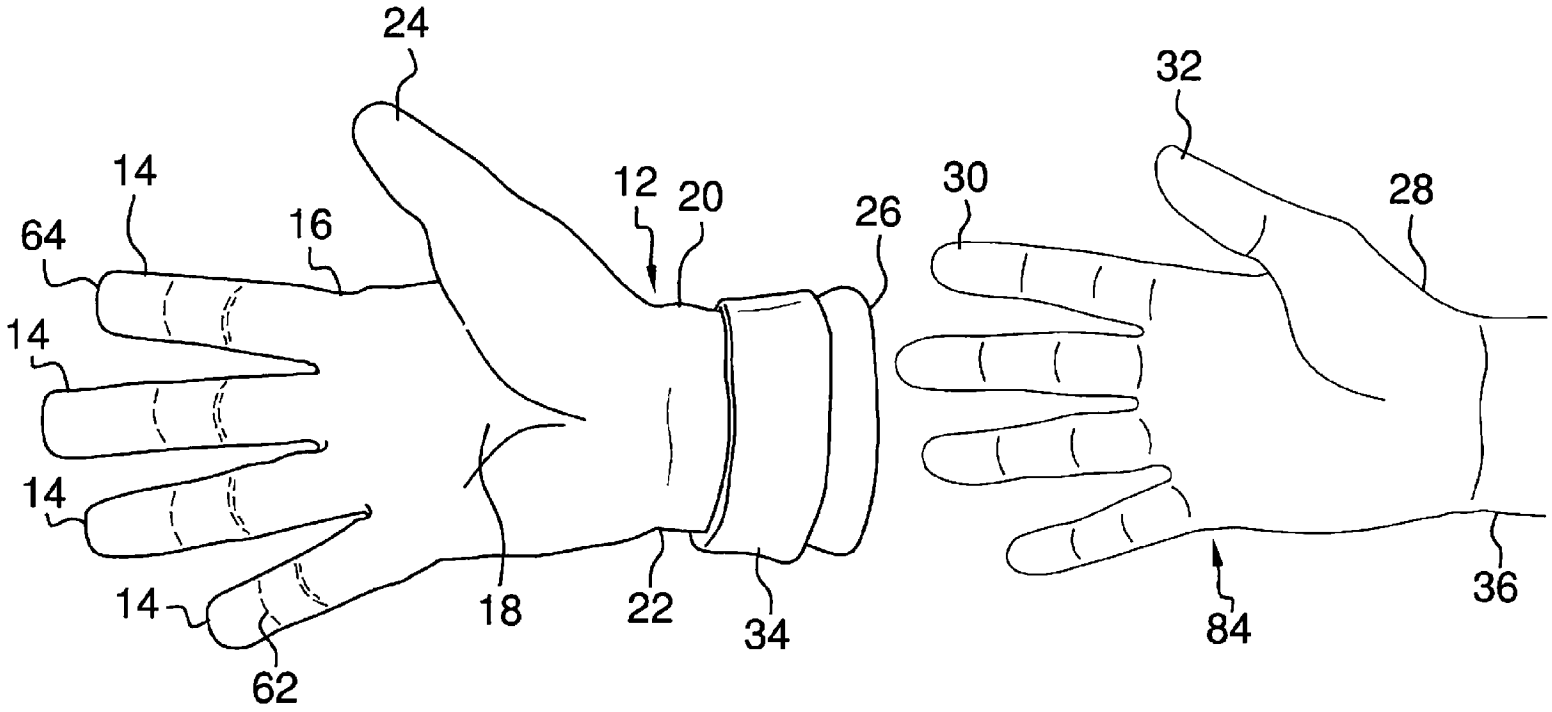
FIG. 2 is a bottom perspective view of an embodiment of the disclosure.
Figure 3:
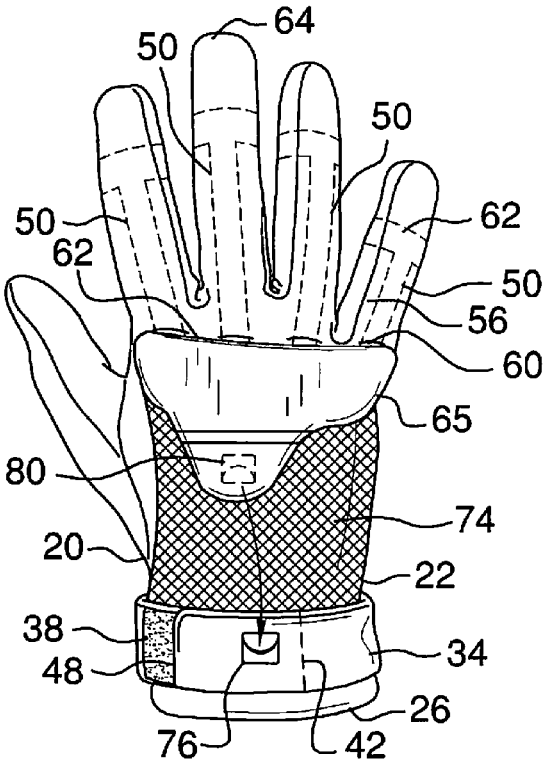
FIG. 3 is a top view of an embodiment of the disclosure.
Figure 4:
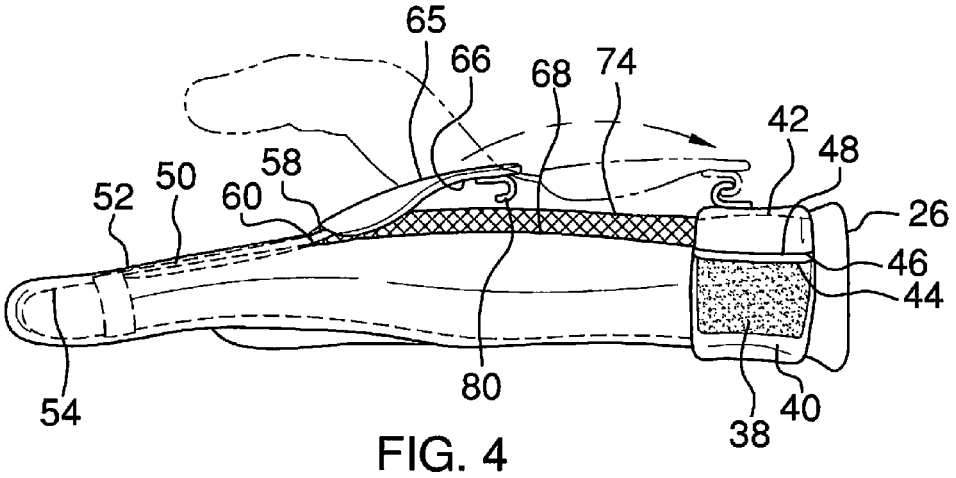
FIG. 4 is a left side view of an embodiment of the disclosure.
Figure 5:
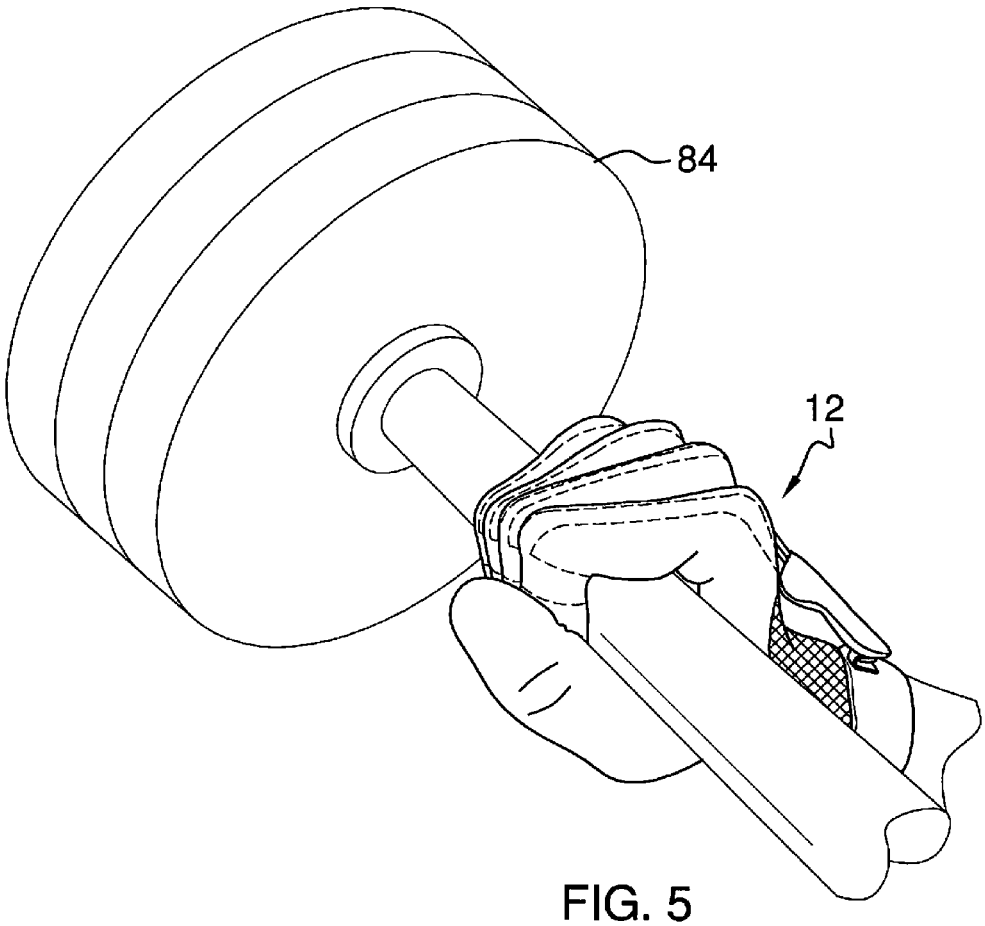
FIG. 5 is an in-use view of an embodiment of the disclosure.
Figure 6:
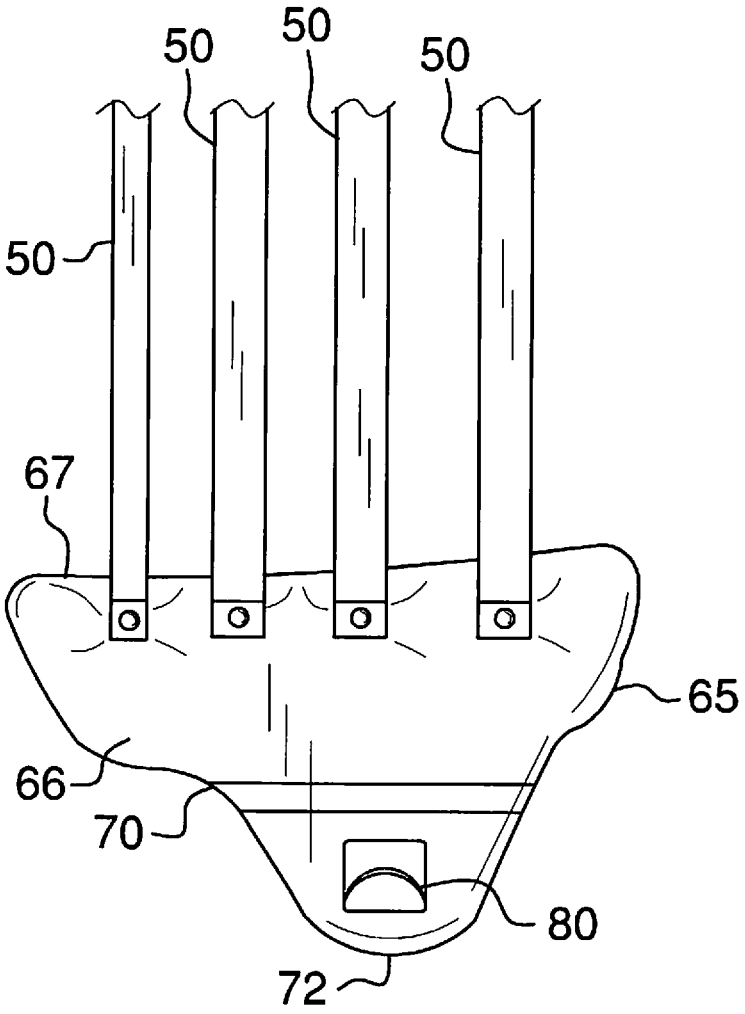
FIG. 6 is a bottom view of an embodiment of the disclosure.

With reference now to the drawings, and in particular to FIGS. 1 through 6 thereof, a new exercise device embodying the principles and concepts of an embodiment of the disclosure and generally designated by the reference numeral 10 will be described.

As best illustrated in FIGS. 1 through 6, the exercise assembly 10 generally comprises an article of apparel 12 comprising a finger portion 14 of the article of apparel 12 coupled to and extending forwardly from a front 16 of a hand portion 18 of the article of apparel 12. Moreover, the finger portion 14 of the article of apparel 12 is one of a plurality of the finger portions 14 of the article of apparel 12. The plurality of finger portions 14 of the article of apparel 12 is evenly distributed between a first lateral side 20 and a second lateral side 22 of the hand portion 18 of the article of apparel 12. Continuing, a thumb portion 24 of the article of apparel 12 is coupled to and extends laterally away from the first lateral side 20 of the hand portion 18 of the article of apparel 12. The thumb portion 24 of the article of apparel 12 is positioned proximate an open end 26 of the article of apparel 12. Lastly, the article of apparel 12 may be a glove of any conventional design.

The open end 26 of the article of apparel 12 insertably receives a user's hand 28. The user's hand 28 is positioned within the hand portion 18 of the article of apparel 12. Continuing, each of the users' fingers 30 is positioned within an associated one of the plurality of finger portions 14 of the article of apparel 12. The user's thumb 32 is positioned within the thumb portion 24 of the article of apparel 12. Finally, the hand portion 18, the plurality of finger portions 14 and the thumb portion 24 of the article of apparel 12 may be comprised of a deformable material.

A strap 34 is coupled around the hand portion 18 of the article of apparel 12 proximate the open end 26 of the article of apparel 12. The strap 34 selectively tightens the open end 26 of the article of apparel 12 around the user's wrist 36 after the user's hand 28 is positioned within the article of apparel 12. A first coupler 38 is coupled to a top 40 of the strap 34 proximate a first end 42 of the strap 34. Additionally, a second coupler 44 is coupled to a bottom 46 of the strap 34 proximate a second end 48 of the strap 34. The first 38 and second 44 couplers may be complementary hook and loop fasteners so the second end 48 of the strap 34 is selectively retained on the first end 42 of the strap 34. Lastly, the second end 48 of the strap 34 is drawn across the first end 42 of the strap 34 to tighten the open end 26 of the article of apparel 12.

A resistance band 50 is operationally coupled to the finger portion 14 of the article of apparel 12. The resistance band 50 is positioned between a top surface 52 and a bottom surface 54 of a top 56 of the finger portion 14 of the article of apparel 12. Continuing, a back end 58 of the resistance band 50 extends outwardly from a resistance band opening 60 in the top 56 of the finger portion 14 of the article of apparel 12. A front portion 62 of the resistance band 50 comprises a closed loop. Moreover, the front portion 62 of the resistance band 50 extends around an entire circumference of the finger portion 14 of the article of apparel 12 proximate a front end 64 of the finger portion 14 of the article of apparel 12. Lastly, the resistance band 50 may be comprised of a resiliently stretchable material.

The resistance band 50 is one of a plurality of the resistance bands 50 each operationally coupled to an associated one of the plurality of finger portions 14 of the article of apparel 12. A handle 65 is operationally coupled to the article of apparel 12. Additionally, a bottom 66 of the handle 52 is coupled to the back end 58 of each of the plurality of resistance bands 50 proximate a front edge 67 of the handle. The handle 65 is positioned on a top 68 of the hand portion 18 of the article of apparel 12. Continuing, a back edge 70 of the handle 65 is curved so a prominence 72 on the back edge 70 of the handle extends toward the open end 26 of the article of apparel 12. The handle 65 extends between the first lateral side 20 and the second lateral side 22 of the hand portion 18 of the article of apparel 12.

A mesh material 74 is coupled between the plurality of finger portions 14 of the article of apparel 12 and the strap 34. Further, the mesh material 74 is positioned on the top 68 of the hand portion 18 of the article of apparel 12. The mesh material 74 extends between the first lateral side 20 and the second lateral side 22 of the hand portion 18 of the article of apparel 12.

A first clip 76 is coupled to the top 40 of the strap 34 proximate the second end 48 of the strap 34. Further, a second clip 80 is coupled to the bottom 66 of the prominence 72 of the handle 65. The handle 65 is selectively urged toward the open end 26 of the article of apparel 12. Moreover, each of the plurality of resistance bands 50 urges an associated one of the plurality of finger portions 14 of the article of apparel 12 into a resisting position. The plurality of finger portions 14 of the article of apparel 12 angle upwardly from the hand portion 18 of the article of apparel 12 in the resisting position. The plurality of finger portions 14 of the article of apparel 12 are positioned in a neutral position if the handle 65 is not urged toward the open end 26 of the article of apparel 12.

The second clip 80 engages the first clip 76 when the handle 65 is urged toward the open end 26 of article of apparel 12. Moreover, the plurality of finger portions 14 of the article of apparel 12 is retained in the resisting position. The user's fingers 30 selectively resist against the plurality of resistance bands 50. Lastly, the plurality of resistance bands 50 may each produce a resistance between 225 g and 450 g In use, the plurality of finger portions 14 of the article of apparel 12 are positioned in the resisting position when the user 84 wishes to exercise. The user 84 grips a barbell 86 while the finger portions 14 of the article of apparel 12 are in the resisting position so the user's fingers 30 are strengthened. Further, the user 84 may use the assembly 10 without the barbell 86. The user 84 moves the user's fingers 30 against the plurality of resistance bands 50 to strengthen the user's fingers 30. Lastly, the assembly 10 may be used with the finger portions 14 of the article of apparel 12 in the resisting position or in the neutral position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An exercise assembly for selectively providing resistance to a user's hand, said assembly comprising:

an article of apparel configured to be worn on the user's hand;

a resistance band operationally coupled to said article of apparel; and a handle operationally coupled to said article of apparel, said handle being coupled to said resistance band wherein said handle selectively places said resistance band in a resisting position wherein said resistance band is configured to provide resistance to the user's hand; and said resistance band being operationally coupled to a finger portion of said article of apparel wherein said resistance band is positioned between a top surface and a bottom surface of a top of said finger portion of said article of apparel wherein a back end of said resistance band extends outwardly from a resistance band opening in said top of said finger portion of said article of apparel.

2. The assembly according to claim 1 further comprising said article of apparel comprising a finger portion of said article of apparel coupled to and extending forwardly from a hand portion of said article of apparel.

3. The assembly according to claim 2 further comprising said finger portion of said article of apparel being one of a plurality of said finger portions of said article of apparel being evenly distributed between a first lateral side and a second lateral side of said hand portion of said article of apparel.

4. The assembly according to claim 1 further comprising a thumb portion of said article of apparel coupled to and extending laterally away from a first lateral side of a hand portion of said article of apparel proximate an open end of said article of apparel.

5. The assembly according to claim 1 further comprising an open end of said article of apparel insertably receiving the user's hand wherein the user's hand is positioned within a hand portion of said article of apparel.

6. The assembly according to claim 5 further comprising wherein each of the users' fingers is positioned within an associated one of a plurality of finger portions of said article of apparel.

7. The assembly according to claim 5 further comprising wherein the user's thumb is positioned within a thumb portion of said article of apparel.

8. The assembly according to claim 1 further comprising a strap coupled around a hand portion of said article of apparel proximate an open end of said article of apparel.

9. The assembly according to claim 8 further comprising said strap selectively tightening said open end of said article of apparel around the user's wrist after the user's hand is positioned within said article of apparel.

10. An exercise assembly for selectively providing resistance to a user's hand, said assembly comprising:

an article of apparel configured to be worn on the user's hand;

a resistance band operationally coupled to said article of apparel; and a handle operationally coupled to said article of apparel, said handle being coupled to said resistance band wherein said handle selectively places said resistance band in a resisting position wherein said resistance band is configured to provide resistance to the user's hand; and a front portion of said resistance band comprising a closed loop wherein said front portion of said resistance band extends around an entire circumference of a finger portion of said article of apparel proximate a front end of said finger portion of said article of apparel.

11. An exercise assembly for selectively providing resistance to a user's hand, said assembly comprising:

an article of apparel configured to be worn on the user's hand;

a resistance band operationally coupled to said article of apparel; and a handle operationally coupled to said article of apparel, said handle being coupled to said resistance band wherein said handle selectively places said resistance band in a resisting position wherein said resistance band is configured to provide resistance to the user's hand; and said resistance band being one of a plurality of said resistance bands each operationally coupled to an associated one of a plurality of finger portions of said article of apparel.

12. The assembly according to claim 11 further comprising a front edge of said handle being coupled to a back end of each of said plurality of said resistance bands wherein said handle is positioned on a top of a hand portion of said article of apparel.

13. An exercise assembly for selectively providing resistance to a user's hand, said assembly comprising:

an article of apparel configured to be worn on the user's hand;

a resistance band operationally coupled to said article of apparel; and a handle operationally coupled to said article of apparel, said handle being coupled to said resistance band wherein said handle selectively places said resistance band in a resisting position wherein said resistance band is configured to provide resistance to the user's hand; and a back edge of said handle being curved wherein a prominence on said back edge of said handle extends toward an open end of said article of apparel.

14. The assembly according to claim 13 further comprising:

a first clip coupled to a top of a strap;

a second clip coupled to a bottom of said prominence of said handle;

said handle being selectively urged toward an open end of said article of apparel wherein each of a plurality of resistance bands urges an associated one of a plurality of finger portions of said article of apparel into a resisting position; and said second clip engaging said first clip when said handle is urged toward said open end of article of apparel wherein said plurality of finger portions of said article of apparel is retained in said resisting position wherein the user's fingers selectively resist against said plurality of resistance bands.

15. The assembly of claim 1, further comprising:

said article of apparel comprising a finger portion of said article of apparel coupled to and extending forwardly from a hand portion of said article of apparel, said finger portion of said article of apparel being one of a plurality of said finger portions of said article of apparel being evenly distributed between a first lateral side and a second lateral side of said hand portion of said article of apparel;

a thumb portion of said article of apparel coupled to and extending laterally away from said first lateral side of said hand portion of said article of apparel proximate said open end of said article of apparel;

an open end of said article of apparel insertably receiving the user's hand wherein the user's hand is positioned within said hand portion of said article of apparel wherein each of the users' fingers is positioned within an associated one of said plurality of finger portions of said article of apparel wherein the user's thumb is positioned within said thumb portion of said article of apparel;

a strap coupled around said hand portion of said article of apparel proximate said open end of said article of apparel, said strap selectively tightening said open end of said article of apparel around the user's wrist after the user's hand is positioned within said article of apparel;

a front portion of said resistance band comprising a closed loop wherein said front portion of said resistance band extends around an entire circumference of said finger portion of said article of apparel proximate a front end of said finger portion of said article of apparel;

said resistance band being one of a plurality of said resistance bands each operationally coupled to an associated one of said plurality of finger portions of said article of apparel;

a front edge of said handle being coupled to said back end of each of said plurality of resistance bands wherein said handle is positioned on a top of said hand portion of said article of apparel, a back edge of said handle being curved wherein a prominence on said back edge of said handle extends toward said open end of said article of apparel;

a first clip coupled to a top of said strap;

a second clip coupled to a bottom of said prominence of said handle;

said handle being selectively urged toward said open end of said article of apparel wherein each of said plurality of resistance bands urges an associated one of said plurality of finger portions of said article of apparel into a resisting position; and said second clip engaging said first clip when said handle is urged toward said open end of article of apparel wherein said plurality of finger portions of said article of apparel is retained in said resisting position wherein the user's fingers selectively resist against said plurality of resistance bands.

* * * * *